US009254448B2

(12) United States Patent
Turner et al.

(10) Patent No.: US 9,254,448 B2
(45) Date of Patent: Feb. 9, 2016

(54) SUBLIMATION SYSTEMS AND ASSOCIATED METHODS

(75) Inventors: Terry D. Turner, Idaho Falls, ID (US); Michael G. McKellar, Idaho Falls, ID (US); Bruce M. Wilding, Idaho Falls, ID (US)

(73) Assignee: BATTELLE ENERGY ALLIANCE, LLC, Idaho Falls, ID (US)

( * ) Notice: Subject to any disclaimer, the term of this patent is extended or adjusted under 35 U.S.C. 154(b) by 747 days.

(21) Appl. No.: 12/938,967

(22) Filed: Nov. 3, 2010

(65) Prior Publication Data

US 2012/0103012 A1 May 3, 2012

(51) Int. Cl.

| | |
|---|---|
| ***F25J 3/00*** | (2006.01) |
| ***B01B 1/00*** | (2006.01) |
| *F25J 3/08* | (2006.01) |
| *F25J 3/06* | (2006.01) |
| *F25J 1/00* | (2006.01) |

(52) U.S. Cl.

CPC ..... *B01B 1/005* (2013.01); *F25J 1/0022* (2013.01); *F25J 1/0027* (2013.01); *F25J 3/061* (2013.01); *F25J 3/067* (2013.01); *F25J 3/08* (2013.01)

(58) Field of Classification Search

CPC ..... F25J 1/0022; F25J 1/0027; F25J 3/08; F25J 3/061; F25J 3/067; F28C 3/10; F28D 15/00; B01D 7/02

USPC ..... 62/614, 618, 637

See application file for complete search history.

(56) References Cited

U.S. PATENT DOCUMENTS

| | | | |
|---|---|---|---|
| 1,222,801 | A | 4/1917 | Rosenbaum |
| 2,037,679 | A | 4/1936 | Dana |
| 2,037,714 | A | 4/1936 | Gaines, Jr. |
| 2,040,059 | A | 5/1936 | Mesinger |
| 2,093,805 | A | 9/1937 | de Baufre |
| 2,157,103 | A | 5/1939 | Zenner |
| 2,209,534 | A | 7/1940 | Moore |
| 2,379,286 | A | 6/1945 | Dodson |

(Continued)

FOREIGN PATENT DOCUMENTS

| | | | |
|---|---|---|---|
| CN | 101539362 | | 9/2009 |
| EP | 0 676 599 | A | 10/1995 |

(Continued)

OTHER PUBLICATIONS

Search Report for PCT/US2006/041039 dated Aug. 8, 2007.

(Continued)

*Primary Examiner* — Frantz Jules
*Assistant Examiner* — Webeshet Mengesha
(74) *Attorney, Agent, or Firm* — TraskBritt

(57) ABSTRACT

A system for vaporizing and sublimating a slurry comprising a fluid including solid particles therein. The system includes a first heat exchanger configured to receive the fluid including solid particles and vaporize the fluid and a second heat exchanger configured to receive the vaporized fluid and solid particles and sublimate the solid particles. A method for vaporizing and sublimating a fluid including solid particles therein is also disclosed. The method includes feeding the fluid including solid particles to a first heat exchanger, vaporizing the fluid, feeding the vaporized fluid and solid particles to a second heat exchanger and sublimating the solid particles. In some embodiments the fluid including solid particles is liquid natural gas or methane including solid carbon dioxide particles.

19 Claims, 2 Drawing Sheets

(56) References Cited

U.S. PATENT DOCUMENTS 2,494,120 A 10/1950 Ferro, Jr.
2,669,941 A 2/1954 Stafford
2,701,641 A 2/1955 Krijgsman
2,830,769 A * 4/1958 Work ..... 241/5
2,858,020 A 10/1958 Bek
2,900,797 A 8/1959 Kurata et al.
2,937,503 A 5/1960 Swearingen et al.
3,132,016 A 5/1964 Kurata
3,168,136 A 2/1965 Ammon
3,182,461 A 5/1965 Johanson
3,193,468 A 7/1965 Sprague
3,213,631 A 10/1965 Kniel
3,218,816 A 11/1965 Grenier
3,236,057 A 2/1966 Hadi Hashemi-Tafreshi
3,254,496 A 6/1966 Roche et al.
3,283,521 A * 11/1966 Harmens ..... 62/637
3,289,756 A 12/1966 Jaeger
3,292,380 A 12/1966 Bucklin
3,310,843 A 3/1967 Mancuso
3,312,073 A 4/1967 Jackson et al.
3,315,475 A 4/1967 Harmens
3,323,315 A 6/1967 Carr
3,326,453 A 10/1967 Kun
3,349,020 A 1/1968 Crownover et al.
3,362,173 A 1/1968 Ludwog
3,376,709 A 4/1968 Dickey et al.
3,406,496 A 10/1968 Betteridge et al.
3,407,052 A 10/1968 Huntress et al.
3,416,324 A 12/1968 Swearingen
3,422,887 A 1/1969 Berkeley
3,448,587 A 6/1969 Goard et al.
3,487,652 A 1/1970 McKay
3,503,220 A 3/1970 Desai
3,516,262 A 6/1970 Bernstein
3,548,606 A 12/1970 Kuerston
3,596,473 A 8/1971 Streich
3,608,323 A 9/1971 Salama
3,616,652 A 11/1971 Engel
3,628,340 A 12/1971 Meisler et al.
3,667,234 A 6/1972 DeLizasoain
3,677,019 A 7/1972 Olszewski
3,690,114 A 9/1972 Swearingen et al.
3,724,225 A 4/1973 Mancini et al.
3,724,226 A 4/1973 Pachaly
3,735,600 A 5/1973 Dowdell et al.
3,846,993 A 11/1974 Bates
3,886,885 A 6/1975 Becker et al.
3,897,226 A 7/1975 Doherty
4,001,116 A 1/1977 Selcukoglu
4,004,430 A 1/1977 Solomon et al.
4,007,601 A 2/1977 Webbon
4,022,597 A 5/1977 Bacon
4,025,315 A 5/1977 Mazelli
4,032,337 A 6/1977 Boyer
4,120,911 A 10/1978 Davidson
4,128,410 A 12/1978 Bacon
4,148,723 A 4/1979 Mozley
4,161,107 A 7/1979 Chemychev et al.
4,183,369 A 1/1980 Thomas
4,187,689 A 2/1980 Selcukoglu et al.
4,294,274 A 10/1981 LeRoy
4,318,723 A 3/1982 Holmes et al.
4,334,902 A 6/1982 Paradowski
4,359,871 A 11/1982 Strass
4,370,150 A 1/1983 Fenstermaker
4,453,956 A 6/1984 Fabbri et al.
4,456,459 A 6/1984 Brundige
4,479,533 A 10/1984 Persson et al.
4,479,536 A 10/1984 Lameris
4,522,636 A 6/1985 Markbreiter et al.
4,528,006 A 7/1985 Vitovec et al.
4,561,496 A 12/1985 Kehrer
4,609,390 A 9/1986 Wilson
4,611,655 A 9/1986 Molignoni
4,645,522 A 2/1987 Dobrotwir
4,654,522 A 3/1987 Gornick et al.
4,783,272 A 11/1988 Patterson
4,798,242 A 1/1989 Kito et al.
4,822,393 A 4/1989 Markbreiter et al.
4,846,862 A 7/1989 Cook
4,869,313 A 9/1989 Fredley
4,970,867 A 11/1990 Herron et al.
4,993,485 A 2/1991 Gorman
4,994,097 A 2/1991 Brouwers
5,003,782 A 4/1991 Kucerija
5,032,143 A 7/1991 Ritakallio
5,036,671 A 8/1991 Nelson et al.
5,062,270 A 11/1991 Haut et al.
5,074,758 A 12/1991 McIntyre
5,174,796 A 12/1992 Davis et al.
5,218,832 A 6/1993 Woolley
5,252,613 A 10/1993 Chang et al.
5,291,736 A 3/1994 Paradowski
5,325,673 A 7/1994 Durr et al.
5,327,730 A 7/1994 Myers et al.
5,375,422 A 12/1994 Butts
5,379,832 A 1/1995 Dempsey
5,386,699 A 2/1995 Myers et al.
5,390,499 A 2/1995 Rhoades et al.
5,419,392 A 5/1995 Maruyama
5,450,728 A 9/1995 Vora et al.
5,473,900 A 12/1995 Low
5,489,725 A 2/1996 Minkkinen et al.
5,505,048 A 4/1996 Ha et al.
5,505,232 A 4/1996 Barclay
5,511,382 A 4/1996 Denis et al.
5,537,827 A 7/1996 Low et al.
5,551,256 A 9/1996 Schmidt
5,600,969 A 2/1997 Low
5,615,561 A 4/1997 Houshmand et al.
5,615,738 A 4/1997 Cameron et al.
5,655,388 A 8/1997 Bonaquist et al.
5,669,234 A 9/1997 Houser et al.
5,704,227 A * 1/1998 Krabbendam ..... 62/617
5,718,126 A 2/1998 Capron et al.
5,755,114 A 5/1998 Foglietta
5,755,280 A 5/1998 Da Costa et al.
5,799,505 A 9/1998 Bonaquist et al.
5,819,555 A 10/1998 Engdahl
5,836,173 A 11/1998 Lynch et al.
5,916,260 A 6/1999 Dubar
5,950,453 A 9/1999 Bowen et al.
5,956,971 A 9/1999 Cole et al.
5,983,665 A 11/1999 Howard et al.
6,023,944 A 2/2000 Blundell
6,041,620 A 3/2000 Olszewski et al.
6,085,546 A 7/2000 Johnston
6,085,547 A 7/2000 Johnston
6,105,390 A 8/2000 Bingham et al.
6,131,395 A 10/2000 Greene et al.
6,131,407 A 10/2000 Wissolik
6,138,473 A 10/2000 Boyer-Vidal
6,138,746 A 10/2000 Livolsi et al.
6,196,021 B1 3/2001 Wissolik
6,200,536 B1 3/2001 Tonkovich et al.
6,212,891 B1 4/2001 Minta et al.
6,220,052 B1 4/2001 Tate, Jr. et al.
6,220,053 B1 4/2001 Hass et al.
6,250,244 B1 6/2001 Dubar et al.
6,295,833 B1 10/2001 Hoffart et al.
6,301,927 B1 10/2001 Reddy
6,354,105 B1 3/2002 Lee et al.
6,367,286 B1 4/2002 Price
6,370,910 B1 4/2002 Grootjans et al.
6,372,019 B1 4/2002 Alferov et al.
6,375,906 B1 4/2002 Edlund et al.
6,378,330 B1 4/2002 Minta et al.
6,382,310 B1 5/2002 Smith
6,389,844 B1 5/2002 Klein Nagel Voort
6,390,114 B1 5/2002 Haandrikman et al.
6,397,936 B1 6/2002 Crowley et al.
6,400,896 B1 6/2002 Longardner
6,410,087 B1 6/2002 Wilde et al.
6,412,302 B1 7/2002 Foglietta

(56) References Cited

U.S. PATENT DOCUMENTS

| | | | | |
|---|---|---|---|---|
| 6,425,263 | B1 | 7/2002 | Bingham et al. | |
| 6,427,464 | B1 | 8/2002 | Beaverson et al. | |
| 6,441,263 | B1 | 8/2002 | O'Rear et al. | |
| 6,442,969 | B1 | 9/2002 | Rojey et al. | |
| 6,446,465 | B1 | 9/2002 | Dubar | |
| 6,484,533 | B1 | 11/2002 | Allam et al. | |
| 6,581,409 | B2 | 6/2003 | Wilding et al. | |
| 6,581,510 | B2 | 6/2003 | Koch et al. | |
| 6,694,774 | B1 | 2/2004 | Rashad et al. | |
| 6,742,358 | B2 | 6/2004 | Wilkinson et al. | |
| 6,767,388 | B2 | 7/2004 | Lecomte et al. | |
| 6,793,712 | B2 | 9/2004 | Qualls | |
| 6,962,060 | B2 | 11/2005 | Petrowski et al. | |
| 6,962,061 | B2 | 11/2005 | Wilding et al. | |
| 7,078,011 | B2 | 7/2006 | Morrow | |
| 7,219,512 | B1 | 5/2007 | Wilding et al. | |
| 7,228,714 | B2 | 6/2007 | Howard | |
| 7,231,784 | B2 | 6/2007 | Howard et al. | |
| 7,288,231 | B2 | 10/2007 | Tonkovich et al. | |
| 7,325,415 | B2 | 2/2008 | Amin et al. | |
| 7,469,556 | B2 | 12/2008 | Howard | |
| 7,575,624 | B2 | 8/2009 | Cartwright et al. | |
| 7,591,150 | B2 | 9/2009 | Turner et al. | |
| 7,591,648 | B2 | 9/2009 | Mosiewicz | |
| 7,594,414 | B2 | 9/2009 | Wilding et al. | |
| 7,765,920 | B2 | 8/2010 | Keller | |
| 8,245,727 | B2 | 8/2012 | Mooney et al. | |
| 8,250,883 | B2 | 8/2012 | Migliore et al. | |
| 2003/0196452 | A1 | 10/2003 | Wilding et al. | |
| 2004/0083888 | A1 | 5/2004 | Qualls | |
| 2004/0105812 | A1 | 6/2004 | Tonkovich et al. | |
| 2004/0148962 | A1 | 8/2004 | Rashad et al. | |
| 2004/0177646 | A1* | 9/2004 | Wilkinson et al. | 62/614 |
| 2005/0144979 | A1 | 7/2005 | Zollinger et al. | |
| 2005/0183452 | A1 | 8/2005 | Hahn et al. | |
| 2005/0220704 | A1 | 10/2005 | Morrow et al. | |
| 2005/0279132 | A1 | 12/2005 | Eaton et al. | |
| 2006/0053806 | A1 | 3/2006 | Tassel | |
| 2006/0213222 | A1 | 9/2006 | Whitesell | |
| 2006/0218939 | A1 | 10/2006 | Turner et al. | |
| 2007/0017250 | A1 | 1/2007 | Turner | |
| 2007/0107465 | A1 | 5/2007 | Turner et al. | |
| 2007/0137246 | A1 | 6/2007 | McKellar et al. | |
| 2007/0193303 | A1 | 8/2007 | Hawrysz et al. | |
| 2008/0156035 | A1 | 7/2008 | Aspelund et al. | |
| 2008/0264076 | A1 | 10/2008 | Price et al. | |
| 2009/0071634 | A1* | 3/2009 | Turner et al. | 165/104.26 |
| 2009/0217701 | A1 | 9/2009 | Minta et al. | |
| 2009/0248174 | A1 | 10/2009 | Taha et al. | |
| 2009/0277217 | A1 | 11/2009 | Ransbarger et al. | |
| 2010/0018248 | A1 | 1/2010 | Fieler et al. | |
| 2010/0088920 | A1 | 4/2010 | LaRou | |
| 2010/0186446 | A1 | 7/2010 | Turner et al. | |
| 2010/0223950 | A1 | 9/2010 | Malsam | |
| 2010/0313597 | A1 | 12/2010 | Bridgwood | |
| 2011/0196159 | A1 | 8/2011 | De Munck et al. | |
| 2012/0103428 | A1 | 5/2012 | Turner et al. | |
| 2012/0103561 | A1 | 5/2012 | Turner et al. | |
| 2013/0340475 | A1 | 12/2013 | Turner et al. | |

FOREIGN PATENT DOCUMENTS

| | | | |
|---|---|---|---|
| EP | 1 205 721 | A1 | 5/2002 |
| FR | 2805034 | | 8/2001 |
| GB | 1135871 | | 12/1968 |
| JP | 58-159830 | | 9/1983 |
| JP | 11200817 | A | 7/1999 |
| JP | 2002071861 | A | 3/2002 |
| WO | 88/00936 | | 2/1988 |
| WO | 98/59206 | | 12/1998 |
| WO | 9859205 | | 12/1998 |
| WO | 0144735 | | 6/2001 |
| WO | 03/062725 | A | 7/2003 |
| WO | 03064947 | | 8/2003 |
| WO | 2005114076 | | 12/2005 |
| WO | 2010023238 | A1 | 3/2010 |

OTHER PUBLICATIONS

Search Report for PCT/US2007/084677 dated Jul. 1, 2008.

International Preliminary Report for PCT/US08/68938 dated Mar. 16, 2010.

Search Report for PCT/US2010/045340 dated Oct. 13, 2010.

Search Report for PCT/US2010/045332 dated Oct. 18, 2010.

Search Report for PCT/US2008/051012 dated May 20, 2008.

Search Report for PCT/US2010/045321 dated Oct. 1, 2010.

International Preliminary Examination Report for PCT/US2002/20924 dated Jun. 17, 2003.

Search Report for PCT/US1998/027232, dated Jul. 7, 1999.

A National Vision of America's Transition to a Hydrogen Economy-To 2030 and Beyond, Based on the results of the National Hydrogen Vision Meeting Washington, DC Nov. 15-16, 2001, United States Department of Energy.

Curtin University of Technology, LNG Microcell Progress Update, May 2002, Curtin/Corelab.

Generation of Hydrogen and Transportation and Transmission of Energy Generated on the U.S. Outer Continental Shelf to Onshore, (Minerals Management Service), May 2006.

Holmes et al., "Ryan/Holmes Cryogenic Acid Gas/Hydrocarbon Separations Provide Economic Benefits for LNG Production," 7th International Conference on Liquefied Natural Gas; Jakarta, Indonesia; May 1983; Institute of Gas Technology, Session II, vol. 1, P.

Hydrogen as an Energy Carrier and its Production by Nuclear Power, IAEA-TECDOC-1085, International Atomic Energy Agency, May 1999.

"Hydrogen Infrastructure Delivery, Reliability R&D Needs," Science Applications International Corporation, Prepared for U.S. Department of Energy, NETL Natural Gas & Infrastructure Reliability Program, 2007, <www.netl.doe.gov/technologies/oil-gas/publications/td/Final%20White%20Paper%020072604.pdf>.

International Search Report for PCT/US02/20924, dated 17 Sep. 2002 (4 pages).

Mott Corporation, "Porous metal solutions," Jun. 2007, 16 pages.

Porous Metal Design Guidebook, Metal Powder Industries Federation, Princeton, NJ, <<http://www.mpif.org/designcenter/porous.pdf>>, Jun. 2007, 25 pages.

The Hydrogen Economy: Opportunities, Costs, Barriers, and R&D Needs, National Academy of Engineering and Board on Energy and Environmental Systems, 2004, The National Academies Press, <http://books.nap.edu/ books/0309091632/html/index.html>.

The Hydrogen Initiative, Panel on Public Affairs, American Physical Society, Mar. 2004, <http://www.aps.org/public_affairs/popa/reports/index.cfm>.

PCT International Preliminary Report on Patentability and Written Opinion for PCT/US2006/041039 dated Apr. 9, 2009, 7 pages.

PCT International Preliminary Report on Patentability and Written Opinion for PCT/US2007/084677 dated May 28, 2009, 7 pages.

PCT International Search Report and Written Opinion for PCT/US08/68938 dated Oct. 10, 2008, 8 pages.

PCT International Preliminary Report on Patentability and Written Opinion for PCT/US2008/051012 dated Aug. 27, 2009, 7 pages.

U.S. Appl. No. 12/603,948, filed Oct. 22, 2009, titled, "Complete Liquefaction Methods and Apparatus," by Turner et al.

U.S. Appl. No. 12/604,139, filed Oct. 22, 2009, titled, "Natural Gas Liquefaction Core Modules, Plants Including Same and Related Methods," by Wilding et al.

U.S. Appl. No. 12/604,194, filed Oct. 22, 2009, titled, "Methods of Natural Gas Liquefaction and Natural Gas Liquefaction Plants Utilizing Multiple and Varying Gas Streams," by Wilding et al.

PCT International Preliminary Report on Patentability and Written Opinion for PCT/US2010/045321 dated Oct. 1, 2010, 6 pages.

PCT International Preliminary Report on Patentability and Written Opinion for PCT/US2010/045332 dated Oct. 18, 2010, 11 pages.

(56) References Cited

OTHER PUBLICATIONS

PCT International Search Report and Written Opinion of the International Searching Authority for PCT/US2011/059042, dated Mar. 16, 2012, 9 pages.

Bodner Research Web, "Phase Diagrams," http://chemed.chem.purdue.edu/genchem/topicreview/bp/ch14/phase.php.

PCT International Search Report and Written Opinion of the International Searching Authority for PCT/US2013/044967, dated Nov. 12, 2013 10 pages.

Relations between height, pressure, density and temperature, http://www.aerostudents.com/files/aerodynamicsA/relationsPressureHeight.pdf.

Office Action for Chinese Patent Application No. 201180051616.6, Issued May 11, 2015, 8 pages.

* cited by examiner

SUBLIMATION SYSTEMS AND ASSOCIATED METHODS

CONTRACTUAL ORIGIN OF THE INVENTION

This invention was made with government support under Contract Number DE-AC07-05ID14517 awarded by the United States Department of Energy. The government has certain rights in the invention.

CROSS-REFERENCE TO RELATED APPLICATIONS

The present application is related to U.S. patent application Ser. No. 11/855,071, filed Sep. 13, 2007, now U.S. Pat. No. 8,061,413, titled HEAT EXCHANGER, co-pending U.S. patent application Ser. No. 12/938,761, filed Nov. 3, 2010, titled VAPORIZATION CHAMBERS AND ASSOCIATED METHODS, and co-pending U.S. patent application Ser. No. 12/938,826, filed Nov. 3, 2010, titled HEAT EXCHANGER AND RELATED METHODS. The disclosure of each of the foregoing applications is hereby incorporated herein by reference in its entirety. The present application is also related to U.S. patent application Ser. No. 12/603,948, filed Oct. 22, 2009, now U.S. Pat. No. 8,555,672 titled COMPLETE LIQUEFACTION METHODS AND APPARATUS, and co-pending U.S. patent application Ser. No. 12/604,194, filed Oct. 22, 2009, now U.S. Pat. No. 8,899,074, titled METHODS OF NATURAL GAS LIQUEFACTION PLANTS UTILIZING MULTIPLE AND VARYING GAS STREAMS.

FIELD OF THE INVENTION

The present invention relates generally to systems for vaporization and sublimation and methods associated with the use thereof. More specifically, embodiments of the invention relate to a first heat exchanger configured to vaporize a fluid including solid particles therein and a second heat exchanger configured to sublimate the solid particles. Embodiments of the invention additionally relate to methods of heat transfer between fluids, the sublimation of solid particles within a fluid, and the conveyance of fluids.

BACKGROUND

The production of liquefied natural gas is a refrigeration process that reduces the mostly methane ($CH_4$) gas to a liquid state. However, natural gas consists of a variety of gases in addition to methane. One of the gases contained in natural gas is carbon dioxide ($CO_2$). Carbon dioxide is found in quantities around 1% in most of the natural gas infrastructure found in the United States, and in many places around the world the carbon content is much higher.

Carbon dioxide can cause problems in the process of natural gas liquefaction, as carbon dioxide has a freezing temperature that is higher than the liquefaction temperature of methane. The high freezing temperature of carbon dioxide relative to methane will result in solid carbon dioxide crystal formation as the natural gas cools. This problem makes it necessary to remove the carbon dioxide from the natural gas prior to the liquefaction process in traditional plants. The filtration equipment to separate the carbon dioxide from the natural gas prior to the liquefaction process may be large, may require significant amounts of energy to operate, and may be very expensive.

Small-scale liquefaction systems have been developed and are becoming very popular. In most cases, these small plants are simply using a scaled down version of existing liquefaction and carbon dioxide separation processes. The Idaho National Laboratory has developed an innovative small-scale liquefaction plant that eliminates the need for expensive, equipment intensive, pre-cleanup of the carbon dioxide. The carbon dioxide is processed with the natural gas stream, and during the liquefaction step the carbon dioxide is converted to a crystalline solid. The liquid/solid slurry is then transferred to a separation device that directs a clean liquid out of an overflow, and a carbon dioxide concentrated slurry out of an underflow.

The underflow slurry is then processed through a heat exchanger to sublime the carbon dioxide back into a gas. In theory this is a very simple step. However, the interaction between the solid carbon dioxide and liquid natural gas produces conditions that are very difficult to address with standard heat exchangers. In the liquid slurry, carbon dioxide is in a pure or almost pure sub-cooled state and is not soluble in the liquid. The carbon dioxide is heavy enough to quickly settle to the bottom of most flow regimes. As the settling occurs, piping and ports of the heat exchanger can become plugged as the quantity of carbon dioxide builds. In addition to collecting in undesirable locations, the carbon dioxide has a tendency to clump together making it even more difficult to flush through the system.

The ability to sublime the carbon dioxide back into a gas is contingent on getting the solids past the liquid phase of the gas and into a warmer section of a device without collecting and clumping into a plug. As the liquid natural gas is heated, it will remain at approximately a constant temperature of about −230° F. (at 50 psig) until all the liquid has passed from a two-phase gas to a single-phase gas. The solid carbon dioxide will not begin to sublime back into a gas until the surrounding gas temperatures have reached approximately −80° F. While the solid carbon dioxide is easily transported in the liquid methane, the ability to transport the solid carbon dioxide crystals to warmer parts of the heat exchanger is substantially diminished as liquid natural gas vaporizes. At a temperature when the moving, vaporized natural gas is the only way to transport the solid carbon dioxide crystals, the crystals may begin to clump together due to the tumbling interaction with each other, leading to the aforementioned plugging.

In addition to clumping, as the crystals reach warmer areas of the heat exchanger they begin to melt or sublime. If melting occurs, the surfaces of the crystals becomes sticky causing the crystals to have a tendency to stick to the walls of the heat exchanger, reducing the effectiveness of the heat exchanger and creating localized fouling. The localized fouling areas may cause the heat exchanger to become occluded and eventually plug if fluid velocities cannot dislodge the fouling.

In view of the shortcomings in the art, it would be advantageous to provide a system and associated methods that would enable the effective and efficient sublimation of solid particles found within a slurry. Additionally, it would be desirable for a system and associated methods to be able to effectively and efficiently warm and vaporize slurries of fluids containing solid particles.

BRIEF SUMMARY

In accordance with one embodiment of the invention, a method for vaporizing and sublimating a fluid including solid particles is provided. The method includes feeding a slurry comprising solid particles suspended in a first fluid to a first heat exchanger, vaporizing the first fluid in the first heat exchanger to form a first gas, feeding the first gas and the solid particles to a second heat exchanger, and sublimating the solid particles in the second heat exchanger to form a second gas.

In accordance with another embodiment of the invention, a method is provided for continuously vaporizing a slurry of liquid methane and solid carbon dioxide particles. The method includes feeding the slurry of liquid methane and solid carbon dioxide particles to a first heat exchanger, vaporizing the liquid methane in the first heat exchanger to form a mixture of solid carbon dioxide particles and gaseous methane, feeding the mixture of solid carbon dioxide particles and gaseous methane to a second heat exchanger, and sublimating the solid carbon dioxide particles in the second heat exchanger.

In accordance with a further embodiment of the invention, a system for vaporizing and sublimating a fluid including solid particles is provided. The system includes a first heat exchanger configured to receive the fluid including solid particles and to vaporize the fluid and a second heat exchanger configured to receive the vaporized fluid and solid particles and to sublimate the solid particles.

BRIEF DESCRIPTION OF THE DRAWINGS

While the specification concludes with claims particularly pointing out and distinctly claiming that which is regarded as the present invention, advantages of this invention may be more readily ascertained from the following detailed description when read in conjunction with the accompanying drawings in which:

DETAILED DESCRIPTION

Some of the illustrations presented herein are not meant to be actual views of any particular material, device, or system, but are merely idealized representations that are employed to describe the present invention. Additionally, elements common between figures may retain the same numerical designation.

Figure 1:
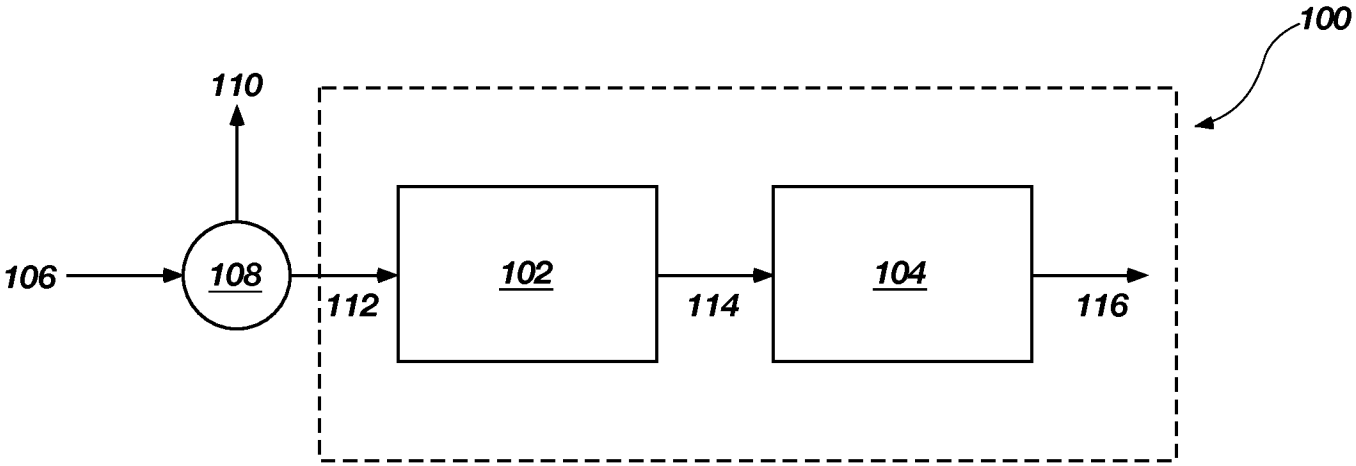
FIGS. 1 and 2 are simplified schematics of a system for continuously vaporizing a fluid including solid particles suspended therein according to particular embodiments of the invention.

FIG. 1 illustrates a system 100 according to an embodiment of the present invention. It is noted that, while operation of embodiments of the present invention is described in terms of the sublimation of carbon dioxide in the processing of natural gas, the present invention may be utilized for the sublimation, heating, cooling, and mixing of other fluids and for other processes, as will be appreciated and understood by those of ordinary skill in the art.

The term "fluid" as used herein means any substance that may be caused to flow through a conduit and includes but is not limited to gases, two-phase gases, liquids, gels, plasmas, slurries, solid particles, and any combination thereof.

As shown in FIG. 1, system 100 may comprise a first heat exchanger referred to herein as a vaporization chamber 102 and a second heat exchanger referred to herein as a sublimation chamber 104. In one embodiment, a product stream 106 including a plurality of solid particles suspended in a first fluid may be sent to a separator 108 to remove a portion of the first fluid from the solid particles to form a fluid product stream 110 and a slurry 112 comprising the solid particles and a remaining portion of the first fluid. The slurry 112 may then be fed to the vaporization chamber 102. Within the vaporization chamber 102, the remaining first fluid in the slurry 112 may be vaporized, forming a first gas and the solid particles 114. The first gas and the solid particles 114 may then be fed to the sublimation chamber 104. Within the sublimation chamber 104, the solid particles sublimate, forming a second gas that is combined with the first gas and exits the sublimation chamber 104 as an exit gas 116. In one embodiment, the first fluid may comprise liquid natural gas and the solid particles may comprise solid carbon dioxide crystals.

Figure 2:
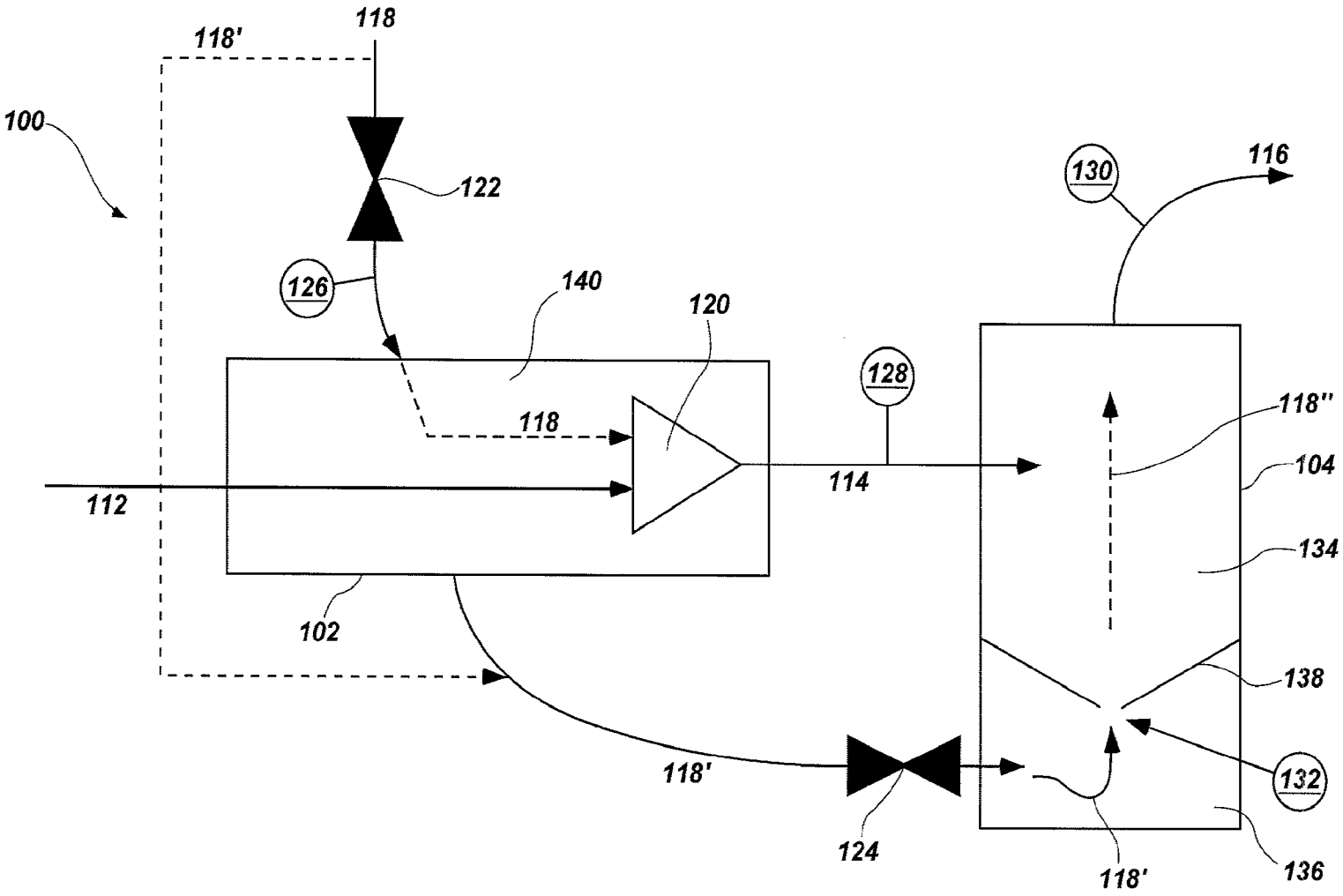

FIG. 2 illustrates a more detailed schematic of one embodiment of the system 100 of FIG. 1. As shown in FIG. 2, the slurry 112 of the solid particles and the first fluid are fed to the vaporization chamber 102. The slurry 112 may be at a pressure above the saturation pressure of the first fluid to prevent vaporization of the first fluid before entering the vaporization chamber 102. A second fluid 118 may also be fed to the vaporization chamber 102. The slurry 112 may be fed to the vaporization chamber 102 at a first temperature and the second fluid 118 may be fed to the vaporization chamber 102 at a second temperature, the second temperature being higher than the first temperature. The second fluid 118 mixes with the slurry 112 in a mixer 120 within the vaporization chamber 102. Within the mixer 120, heat may be transferred from the second fluid 118 to the slurry 112 causing the first fluid in the slurry 112 to vaporize forming the first gas and solid particles 114. At least about 95% of the first fluid in the slurry 112 may be vaporized within the vaporization chamber 102.

The vaporization chamber 102 may be configured to vaporize the first fluid in the slurry 112 without altering the physical state of the solid particles within the slurry 112. One embodiment of such a vaporization chamber is described in detail in previously referenced U.S. patent application Ser. No. 12/938,761, titled "Vaporization Chamber and Associated Methods," filed Nov. 3, 2010. Briefly, the vaporization chamber 102 may include a first chamber 140 surrounding a second chamber, which may also be characterized as a mixer 120. The second fluid 118 enters the first chamber 140 of the vaporization chamber 102 and envelops the mixer 120. Heat may be transferred from the second fluid 118 to the mixer 120 heating an outer surface of the mixer 120. The second fluid 118 also enters the mixer 120 and mixes with the slurry 112, as shown in broken lines, within the vaporization chamber 102. In some embodiments, the mixer 120 may comprise a plurality of ports (not shown) that allow the second fluid 118 to enter the mixer 120 and promotes mixing of the second fluid 118 and the slurry 112. In additional embodiments, a wall of the mixer 120 may comprise a porous material that allows a portion of the second fluid 118 to enter the mixer 120 through the porous wall. In some embodiments, another portion of the second fluid 118' may exit the first chamber 140 of the vaporization chamber 102 and be directed to the sublimation chamber 104. Alternatively, in some embodiments, the portion of the second fluid 118' may be directed to the sublimation chamber 104 before entering the vaporization chamber 102, as shown in broken lines.

As shown in FIG. 2, the first gas and the solid particles 114 formed in the vaporization chamber 102 may be fed to the sublimation chamber 104. A portion of the second fluid 118' is also fed to the sublimation chamber 104. A temperature of the portion of the second fluid 118' may be higher than a temperature of the solid particles from the first gas and the solid particles 114. Heat may be transferred from the portion of the second fluid 118' to the solid particles in the sublimation chamber 104, causing the solid particles to sublimate and forming the second gas which gas, which mixes with the first gas and the portion of the second fluid 118' and forms the exit gas 116.

The sublimation chamber 104 may be configured to sublimate the solid particles in the first gas and the solid particles 114 without allowing the particles to melt and stick together, fouling the system 100. One example of such a sublimation chamber 104 is described in detail in previously referenced U.S. patent application Ser. No. 12/938,826, titled "Heat Exchanger and Related Methods," filed Nov. 3, 2010. Briefly, the sublimation chamber 104 may include a first portion 134 and a second portion 136. The first gas and the solid particles 114 may be fed into the first portion 134 of the sublimation chamber 104, and the portion of the second fluid 118' may be fed into the second portion 136 of the sublimation chamber 104. A cone-shaped member 138 may separate the second portion 136 from the first portion 134. At an apex of the cone-shaped member 138 is an opening or a nozzle 132 for directing the portion the second fluid 118' from the second portion 136 to the first portion 134 of the sublimation chamber 104. The nozzle 132 may comprise, for example, a changeable orifice or valve which that may be sized to achieve a column of the second fluid 118" having a desired velocity extending through the first portion 134 of the sublimation chamber 104.

Particles from the first gas and the solid particles 114 may be entrained and suspended within the column of the second fluid 118". As the particles are suspended in the column of the second fluid 118", the column of the second fluid 118" heats the particles and causes the particles to sublimate, forming the second gas. The cone-shaped member 138 helps direct the solid particles into the column of the second fluid 118".

The system 100 may be controlled using at least one valve and at least one temperature sensor. For example, as shown in FIG. 2, a first valve 122 may be used to control the flow of the second fluid 118 into the vaporization chamber 102 and a second valve 124 may be used to control the flow of the portion of the second fluid 118' into the sublimation chamber 104. In some embodiments, the second valve 124 may be omitted and the flow of the second fluid 118, 118' into the vaporization chamber 102 and the sublimation chamber 104, respectively, may be controlled by the first valve 122. Temperature sensors may be placed throughout the system 100. For example, a first temperature sensor 126 may be located to determine the temperature of the second fluid 118 before the second fluid 118 enters the vaporization chamber 102. A second temperature sensor 128 may be located to determine the temperature of the first gas and the solid particles 114. A third temperature sensor 130 may be used determine the temperature of the exit gas 116. The temperatures at the second temperature sensor 128 and the third temperature sensor 130 may be controlled by varying the flow rate of the second fluid 118, 118' using the first valve 122 and the second valve 124. For example, if the temperature at the second temperature sensor 128 is too low, the flow through the first valve 122 (while the second valve 124 remains constant) may be increased to provide more of the second fluid 118 into the vaporization chamber 102. Alternatively, if the temperature at the second temperature sensor 128 is too low, the flow through the second valve 124 may be reduced, thereby increasing the pressure of the second fluid 118 in the vaporization chamber 102 and increasing the flow rate of second fluid 118 into the mixer 120. If the temperature at the third temperature sensor 130 is too low, or if the flow of the portion of the second fluid 118' is too low through the nozzle 132, the flow of the portion of the second fluid 118' through the second valve 124 may be increased. The above operation controls are exemplary only and additional control mechanisms and designs may be utilized, as known in the art. In some embodiments, the first valve 122 and the second valve 124 may be controlled via a computer. Alternatively, in some embodiments, the first valve 122 and the second valve 124 may be controlled manually.

In one embodiment, the system 100 may be used as part of a liquefaction process for natural gas. For example, the present invention may be used in conjunction with an apparatus for the liquefaction of natural gas and methods relating to the same, such as is described in U.S. Pat. No. 6,962,061 to Wilding et al., hereinafter referred to as the "'061" patent, the disclosure of which is incorporated herein in its entirety by reference. The methods of liquefaction of natural gas disclosed in the '061 patent include cooling at least a portion of a mass of natural gas to form a slurry that comprises at least liquid natural gas and solid carbon dioxide. The slurry is flowed into a hydrocyclone (i.e., the separator 108 as shown in FIG. 1) and forms a thickened slurry of solid carbon dioxide in liquid natural gas. The thickened slurry is discharged from the hydrocyclone through an underflow while the remaining portion of the liquid natural gas is flowed through an overflow of the hydrocyclone.

In this embodiment of the invention, the slurry 112 comprises a continuous flow of liquid natural gas and solid carbon dioxide particles as might be produced in a method according to the '061 patent, as it is conveyed into the vaporization chamber 102. As the slurry 112 enters the mixer 120 within the vaporization chamber 102, the second fluid 118, which comprises a continuous flow of heated gas in this example (such as heated natural gas or heated methane), enters the vaporization chamber 102. The second fluid 118 heats the outside of mixer 120 and also enters the mixer 120, as desired. The heat from the second fluid 118 causes the liquid natural gas in the slurry 112 to vaporize. The temperature and pressure within the vaporization chamber 102 may be controlled such that the liquid natural gas in the slurry 112 vaporizes but that the solid carbon dioxide particles do not melt or sublimate. The second fluid 118 and the slurry 112 may be fed to the vaporization chamber 102 in about equal ratios. For example, in one embodiment, the mass flow rate of the second fluid 118 to the vaporization chamber 102 may be about one (1.0) to about one and a half (1.5) times greater than the mass flow rate of the slurry 112 to the vaporization chamber 102. In one embodiment, the mass flow rate of the second fluid 118 to the vaporization chamber 102 is about one and three tenths (1.3) times greater than the mass flow rate of the slurry 112 to the vaporization chamber 102.

As the slurry 112 is conveyed through the vaporization chamber 102, the initial heat energy provided by the second fluid 118 may be used to facilitate a phase change of the liquid methane of the slurry 112 to gaseous methane. As this transition occurs, the temperature of the slurry 112 may remain at about −230° F. (this temperature may vary depending upon the pressure of the fluid) until all of the liquid methane of the slurry 112 is converted to gaseous methane. At this point, the solid carbon dioxide particles of the slurry 112 may now be suspended in the combined gaseous methane from the slurry 112 and second fluid 118, which exits the vaporization chamber 102 as a first gas and the solid particles 114. The temperature of the first gas and solid particles, determined by the second temperature sensor 128, may be controlled via the first valve 122 and the second valve 124 so that the temperature at the second temperature sensor 128 is higher than the vaporization temperature of the methane but colder than the sublimation temperature of the solid carbon dioxide particles. This ensures that the solid carbon dioxide particles do not begin to melt and become sticky within the vaporization chamber 102, preventing fouling of the vaporization chamber 102.

The first gas and the solid particles 114 comprising the vaporized methane and solid carbon dioxide particles are then continuously fed to the sublimation chamber 104. As the first gas and solid particles 114 enter the first portion 134 of the sublimation chamber 104, the portion of the second fluid 118', which again comprises a continuous flow of heated gas in this example (such as heated natural gas or heated methane), enters the second portion 136 of the sublimation chamber 104. The vaporized methane from the first gas and solid particles 114 exits the sublimation chamber 104 as part of the exit gas 116 while the solid carbon dioxide particles gather in the cone-shaped member 138. The portion of the second fluid 118' enters the first portion 134 of the sublimation chamber 104 through the nozzle 132 at about −80° F. (this temperature may vary depending upon the pressure of the fluid environment) forming the column of the second fluid 118". The particles of carbon dioxide are funneled into the column of the second fluid 118" by the cone-shaped member 138 where the carbon dioxide particles are suspended as they change phase from solid to vapor. All of the carbon dioxide particles may be converted to gaseous carbon dioxide. Once the gaseous carbon dioxide is formed, the gaseous carbon dioxide mixes with the gaseous methane from the first gas and the solid particles 114 and the second fluid 118, 118' and exits the sublimation chamber as the exit gas 116.

Stream of exit gas 116 may be monitored to maintain a temperature at the third temperature sensor 130 that may be higher than the sublimation temperature of the solid carbon dioxide. However, it may be desirable to not overheat the exit stream 116, as the exit stream 116 may be reused as a refrigerant when cooling the natural gas to form the liquid natural gas according to the abovementioned U.S. Pat. No. 6,962,061. In one embodiment, the temperature of the exit stream 116 may be maintained at about twenty degrees higher than the sublimation temperature of the solid carbon dioxide. For example, the exit stream 116 may be kept at about −40° F. and about 250 psia. By maintaining the exit stream 116 at about twenty degrees higher than the sublimation temperature of the solid carbon dioxide, all of the solid carbon dioxide in the exit stream 116 will be vaporized while still producing a cold stream for reuse in another heat exchanger.

In one example, the slurry 112 may enter the vaporization chamber 102 at about 245 psia and about −219° F. at a mass flow rate of about 710 lbm/hr. The second fluid may enter the vaporization chamber 102 at about 250 psia and about 300° F. at a mass flow rate of about 950 lbm/hr. The combined vaporized slurry, including the first fluid and the vaporized particles, and the second fluid may exit the system as the exit stream 116 at about −41° F. and about 250 psia.

By using a separate vaporization chamber 102 and sublimation chamber 104 to form the exit gas 116, the process conditions (i.e., pressure and temperature) for each of the vaporization chamber 102 and the sublimation chamber 104 may be optimized for gasifying the liquid and solid components of the slurry 112. By splitting the gasifying process of the slurry 112 into a vaporization chamber 102 and a sublimation chamber 104, the solid particles may be continuously sublimated without fouling the vaporization chamber 102. The system 100, therefore, provides a continuous method of transforming the slurry 112 into the exit gas 116, which may be easily disposed of.

In light of the above disclosure it will be appreciated that the apparatus and methods depicted and described herein enable the effective and efficient conveyance and sublimation of solid particles within a fluid. The invention may further be useful for a variety of applications other than the specific examples provided. For example, the described system and methods may be useful for the effective and efficient mixing, heating, cooling, and/or conveyance of fluids containing solids where there is a temperature difference between the vaporization temperature of the fluid and the sublimation temperature of the solid.

While the invention may be susceptible to various modifications and alternative forms, specific embodiments of which have been shown by way of example in the drawings and have been described in detail herein, it should be understood that the invention is not intended to be limited to the particular forms disclosed. Rather, the invention includes all modifications, equivalents, and alternatives falling within the scope of the invention as defined by the following appended claims and their legal equivalents.

What is claimed is:

1. A method, comprising:

feeding a slurry comprising solid particles suspended in a first fluid to a first heat exchanger;

feeding a second fluid comprising gas having a higher temperature than the slurry into the first heat exchanger to mix with the first fluid and to vaporize the first fluid in the first heat exchanger to form a first gas;

feeding the first gas and the solid particles to a second heat exchanger; and feeding at least a portion of the second fluid comprising gas having a higher temperature than the slurry into the second heat exchanger to mix with the first gas and the solid particles and to sublimate the solid particles in the second heat exchanger to form a second gas.

2. The method of claim 1, wherein feeding the slurry comprising solid particles suspended in the first fluid to the first heat exchanger comprises feeding the slurry comprising solid particles suspended in liquid natural gas to the first heat exchanger.

3. The method of claim 1, wherein feeding the slurry comprising solid particles suspended in the first fluid to the first heat exchanger comprises feeding the slurry comprising solid carbon dioxide particles suspended in the first fluid to the first heat exchanger.

4. The method of claim 1, wherein vaporizing the first fluid in the first heat exchanger to form the first gas comprises heating the slurry to a temperature higher than a vaporization temperature of the first fluid and lower than a sublimation temperature of the solid particles.

5. The method of claim 1, wherein feeding the second fluid comprising gas having a higher temperature than the slurry into the first heat exchanger to mix with the first fluid and to vaporize the first fluid in the first heat exchanger to form the first gas comprises:

feeding the slurry to a mixer;

filling a chamber around the mixer with the second fluid to heat the mixer;

feeding a portion of the second fluid into the mixer; and mixing the slurry and the second fluid to vaporize the first fluid.

6. The method of claim 1, wherein feeding at least a portion of the second fluid comprising gas having a higher temperature than the slurry into the second heat exchanger to mix with the first gas and the solid particles and to sublimate the solid particles in the second heat exchanger to form the second gas comprises:

feeding the first gas and solid particles to a first portion of the second heat exchanger;

feeding the second fluid to a second portion of the second heat exchanger;

supplying the second fluid from the second portion of the second heat exchanger to the first portion of the second heat exchanger; and sublimating the solid particles with heat from the second fluid.

7. The method of claim 6, wherein supplying the second fluid from the second portion of the second heat exchanger to the first portion of the second heat exchanger comprises supplying the second fluid from the second portion of the second heat exchanger to the first portion of the second heat exchanger through an opening formed in an apex of a cone-shaped barrier member and into an interior portion of the cone-shaped barrier member.

8. A method for continuously gasifying a slurry of liquid methane and solid carbon dioxide particles, comprising:

feeding a slurry of liquid methane and solid carbon dioxide particles to a first heat exchanger;

feeding a gas having a higher temperature than the slurry into the first heat exchanger to mix with the liquid methane and to vaporize the liquid methane in the first heat exchanger to form a mixture of solid carbon dioxide particles and gaseous methane;

feeding the mixture of solid carbon dioxide particles and gaseous methane to a second heat exchanger; and feeding a portion of the gas having a higher temperature than the slurry into the second heat exchanger to mix with the solid carbon dioxide particles and gaseous methane and to sublimate the solid carbon dioxide particles in the second heat exchanger.

9. The method of claim 8, wherein feeding a gas into the first heat exchanger comprises feeding additional gaseous methane to the first heat exchanger.

10. The method of claim 9, wherein vaporizing the liquid methane in the first heat exchanger to form a mixture of solid carbon dioxide particles and gaseous methane comprises transferring heat from the additional gaseous methane to the liquid methane to vaporize the liquid methane.

11. The method of claim 9, wherein feeding a portion of the gas having a higher temperature than the slurry into the second heat exchanger comprises feeding a portion of the additional gaseous methane to the second heat exchanger.

12. The method of claim 11, wherein sublimating the solid carbon dioxide particles in the second heat exchanger comprises transferring heat from the portion of the additional gaseous methane to the solid carbon dioxide particles in the second heat exchanger to sublimate the solid carbon dioxide particles.

13. The method of claim 8, wherein vaporizing the liquid methane in the first heat exchanger to form a mixture of solid carbon dioxide particles and gaseous methane comprises vaporizing the liquid methane at a temperature lower than a sublimation temperature of the solid carbon dioxide particles.

14. A system for vaporizing and sublimating a slurry, comprising:

a first heat exchanger comprising a mixer configured to receive the slurry comprising a fluid and solid particles and to receive a gas at a higher temperature than the slurry to mix with the slurry to vaporize the fluid; and a second heat exchanger configured to receive the vaporized fluid and the solid particles from the first heat exchanger and to receive a portion of the gas at the higher temperature than the slurry to mix with the vaporized fluid and the solid particles to sublimate the solid particles.

15. The system of claim 14, wherein at least one of the first heat exchanger and the second heat exchanger is configured to receive the gas comprising at least one of gaseous methane and gaseous natural gas.

16. The system of claim 14, further comprising:

at least one temperature sensor configured to read a temperature of the vaporized fluid and the solid particles; and at least one valve configured to control a flow of the gas responsive to the temperature of the vaporized fluid and the solid particles.

17. The system of claim 14, wherein the first heat exchanger comprises a chamber within a casing substantially surrounding a mixer.

18. The system of claim 17, wherein the mixer is configured to receive and mix the slurry and the gas.

19. The system of claim 14, wherein the second heat exchanger comprises:

a first portion configured to receive the vaporized fluid and the solid particles;

a second portion configured to receive the gas; and a cone-shaped member separating the first portion and the second portion, the cone-shaped member including an opening for transporting the gas into the first portion.

* * * * *